United States Patent [19]

Greenwood et al.

[11] Patent Number: 4,492,190

[45] Date of Patent: Jan. 8, 1985

[54] RECOIL STARTER

[75] Inventors: Leon D. Greenwood, Okemos; Thomas A. Thorsen, Eaton Rapids, both of Mich.

[73] Assignee: Eaton Stamping Company, Eaton Rapids, Mich.

[21] Appl. No.: 486,709

[22] Filed: Apr. 20, 1983

[51] Int. Cl.[3] ..... F02N 1/00

[52] U.S. Cl. ..... 123/185 A; 123/185 BA; 192/42; 192/46

[58] Field of Search ..... 123/185 R, 185 A, 185 B, 123/185 BA, 185 BB, 179 SE; 192/42, 46, 93 R

[56] References Cited

U.S. PATENT DOCUMENTS

| | | | |
|---|---|---|---|
| 2,530,623 | 11/1950 | Martin | 123/185 BA |
| 2,926,648 | 3/1960 | Hamman | 123/179 |
| 3,081,760 | 3/1963 | Hamman | 123/179 |
| 3,099,255 | 7/1963 | Hamman | 123/179 |
| 3,267,922 | 8/1966 | Hamman | 123/179 |
| 3,366,099 | 1/1968 | Kaufman | 123/185 BA |
| 3,375,814 | 4/1968 | Hamman | 123/185 |
| 3,782,355 | 1/1974 | Hamman | 123/185 |
| 3,871,350 | 3/1975 | Hamman | 123/185 |
| 4,068,644 | 1/1978 | Newport | 192/42 |
| 4,127,098 | 11/1978 | Frers et al. | 123/185 |
| 4,149,510 | 4/1979 | Koga et al. | 123/185 BA |

FOREIGN PATENT DOCUMENTS

| | | | |
|---|---|---|---|
| 816257 | 7/1959 | United Kingdom | 123/185 BA |

*Primary Examiner*—Ira S. Lazarus
*Assistant Examiner*—R. S. Bailey
*Attorney, Agent, or Firm*—Beaman & Beaman

[57] ABSTRACT

A recoil starter for internal combustion engines utilizing a rope rotated cranking pulley wherein pulley mounted dogs engage on engine cranking cup when extended. Dog positioning is controlled by an operator, and the dogs are spring biased and shaped to function as detents to maintain the operator in the dog retracting position preventing inadvertent dog extension due to vibration. Additionally, the starter incorporates a skirt for retaining the rope within the pulley rope groove, and the configuration of the starter reduces resistance to engine cooling air flow.

10 Claims, 6 Drawing Figures

RECOIL STARTER

BACKGROUND OF THE INVENTION

Small internal combustion engines are commonly started by rope starters using rope receiving pulleys automatically rewound by a coil spring. Such recoil starters usually employ dogs mounted upon the rope pulley which extend to engage an engine flywheel mounted cranking cup when the pulley is rotated in a cranking direction, and rotation of the pulley in a recoil direction automatically retracts the driving dogs to an inoperative position. Recoil starters of the aforementioned type are typified by the assignee's U.S. Pat. Nos. 2,926,648; 3,375,814; 3,782,355 and 3,871,350. The assignee's U.S. Pat. Nos. 3,081,760; 3,099,255 and 3,267,922 are rotated by spring power and inertia, rather than a rope and recoil spring, but utilize engine cup dog engaging elements similar to those employed in rope type recoil starters.

As apparent from the above patents, the rotating member, either a rope pulley or inertia member, utilizes dogs and an operator to selectively engage the engine cranking cup, and while the dog operator often includes a friction brake, the heavy engine vibration to which starters are subjected will often cause the dog operator or actuator to slowly move in a direction permitting the dogs to extend and engage the rotating engine cranking component. Such inadvertent dog extension is undesirable as the cranking dogs, or engine cup, may be damaged, objectionable noises are produced, and the dogs are subjected to abnormal wear. While various techniques have been utilized to prevent such inadvertent dog extension, such as a spring biased dog actuator and interfering surfaces defined upon the actuator and dog, such innovations have not solved the problem.

Also, known recoil starters have been subject to problems retaining the rope within the pulley groove during recoiling, and further, as recoil starters are usually mounted adjacent the engine flywheel, the cooling air flow produced by the flywheel vanes is often restricted due to the presence of the starter mass and, previously, starter construction has not overcome this problem.

It is an object of the invention to provide a recoil starter for internal combustion engines wherein inadvertent starter dog extension is prevented.

Another object of the invention is to provide a recoil starter for internal combustion engines wherein a concise starter construction is achieved, inadvertent dog extension is prevented and positive means are employed to retain the dog operator in the dog retract position.

A further object of the invention is to provide a recoil starter for internal combustion engines wherein the starter uses a dog operator rotatable about the rope pulley axis, and a spring biased detent is employed to maintain the dog operator in the dog retracted position.

Yet another object of the invention is to provide a recoil starter for internal combustion engines wherein the starter recoil spring is located within a keeper, and the spring keeper includes a skirt extension circumscribing a majority of the rope pulley groove to maintain the rope within the groove during the recoiling.

Yet another object of the invention is to provide a recoil starter of concise configuration wherein the starter components are of a configuration which aids in the flow of cooling air into the engine past the starter.

An additional object of the invention is to provide a recoil starter utilizing a rope pulley having a configuration which cooperates with the engine cranking cup to aid in maintaining a proper relationship between the pulley and cup.

In the practice of the invention, a rope pulley is rotatably mounted upon a housing which is attached to a small internal combustion engine. The starter housing includes louvers or vents through which cooling air may pass as circulated by the engine flywheel, an engine cranking cup being attached to the flywheel. The rope pulley is concentric to the engine flywheel and includes a rope groove in which the starter rope is received. A spiral recoil spring is interposed between the pulley and housing for rewinding the pulley after cranking the engine, and the recoil spring is mounted within a keeper or housing having a skirt extension extending over the rope circumference to maintain the rope within the pulley groove.

Clutch drive dogs are pivotally mounted upon the rope pulley hub and are maintained within recesses by a platelike operator coaxially mounted upon the pulley and frictionally rotatable thereto as controlled by a friction brake. Actuating surfaces defined upon the operator cooperate with the dogs wherein relative movement between the pulley and operator causes the dogs to extend during pulley cranking rotation for engagement with the engine drive cup, and retract during rope pulley rewind or recoiling.

Cam detent engaging surfaces are defined upon the dog operator, and the dogs, themselves, have cam surfaces defined thereon for engaging with the operator surfaces and coil springs imposing an axial force upon the dogs biases the dogs into engagement with the operator, wherein the dogs, themselves, function as detents to prevent inadvertent rotation of the operator due to engine vibration. In this manner, relative movement of the pulley and dog operator is prevented during engine running, and yet the arrangement for restraining the operator against rotation imposes no additional cranking resistance upon the user.

The configuration of the starter, and particularly the rope pulley, closest to the engine flywheel and driving cup, includes surfaces generally converging toward the flywheel which aids in the flow of cooling air through the starter housing into the engine.

From the above, it will be appreciated that the desired objects have been achieved by the subject matter of the invention.

BRIEF DESCRIPTION OF THE DRAWINGS

The aforementioned objects and advantages of the invention will be apparent from the following description and accompanying drawings wherein.

DESCRIPTION OF THE PREFERRED EMBODIMENT

Figure 1:
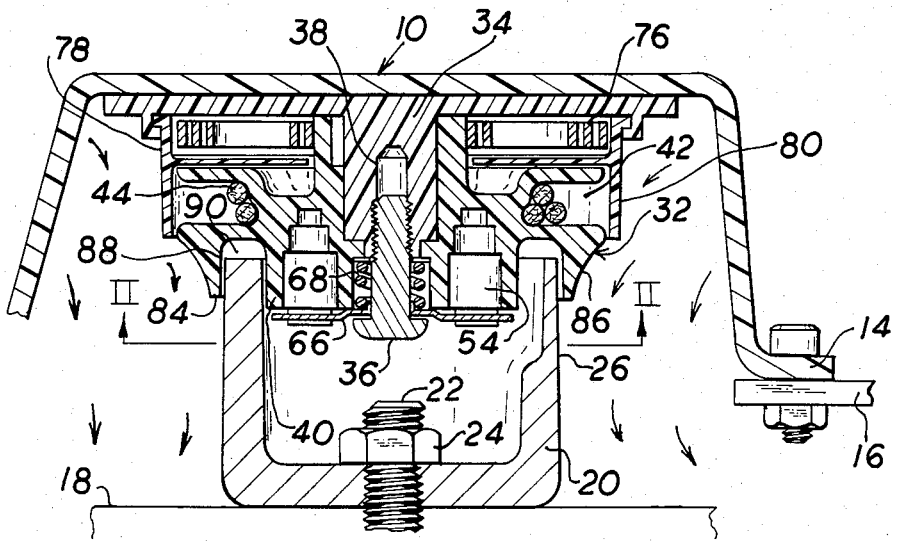
FIG. 1 is a diametrical, elevational, sectional view of a recoil starter in accord with the invention.
Figure 2:
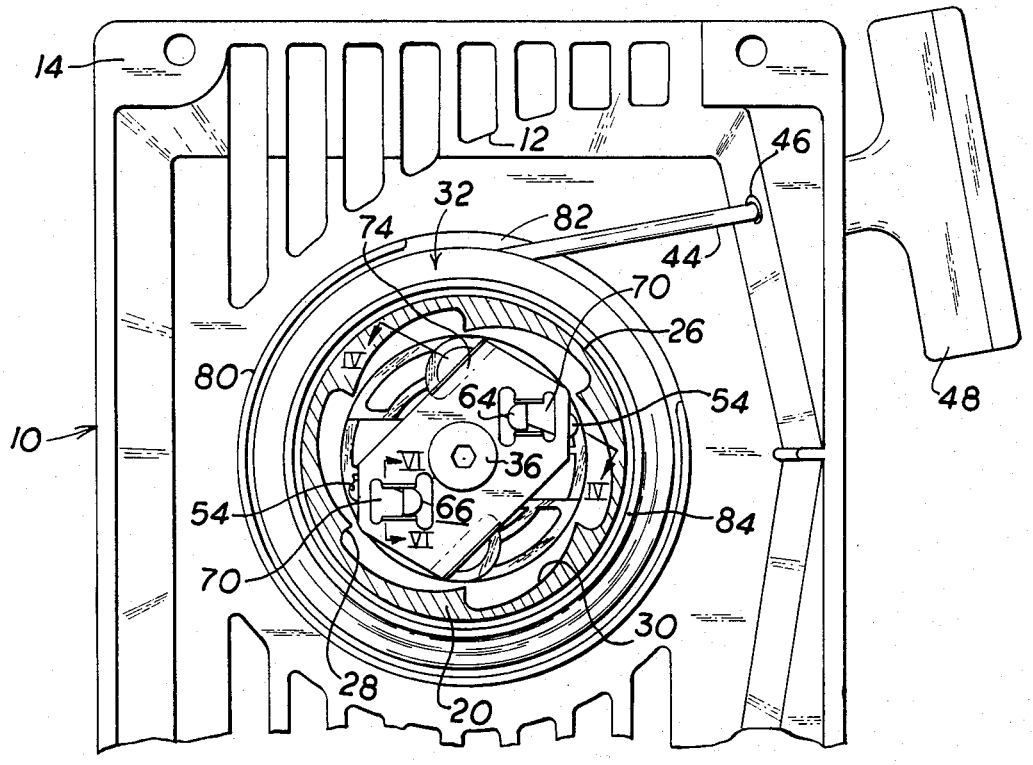
FIG. 2 is a plan view as taken along Section II—II of FIG. 1 illustrating the retracted relationship of the starter components.

With particular reference to FIGS. 1 and 2, the starter includes a housing 10 which may be formed of metal or synthetic plastic material, and the housing includes a plurality of openings or vents 12 defined therein through which air may readily pass. The housing includes a mounting flange 14 having bolt holes defined therein wherein the starter may be attached to the engine housing 16 such that the starter axis will be coaxially related to the engine flywheel axis.

The engine flywheel 18 includes an annular axially extending cup 20, and the cup will usually be formed as a separate component of the flywheel and is bolted to the flywheel on crankshaft 22 by nut 24. Externally, the cup 20 is provided with a cylindrical surface 26, and internally the cup is provided with a plurality of substantially radially extending abutment surfaces 28 engageable by the end of the starter dogs, as later described, and cam surfaces 30.

A synthetic plastic rope pulley 32 is rotatably mounted upon the housing stub shaft 34 and is maintained thereon by a bolt 36 threaded into shaft bore 38. The pulley 32 includes a hub 40 and a rope receiving groove 42 is defined in the pulley for receiving the starter rope 44 wound within the groove. The starter rope extends through the housing opening 46 and is affixed to the handle 48 whereby the pulley may be manually rotated by a handle pull. Preferably, the groove 42 is provided with internal steps to control the position of the coils as described in the assignee's U.S. Pat. No. 3,871,350.

The pulley hub 40 includes a pair of generally cylindrical recesses 50 having an axially extending axis, and the recesses intersect the pulley hub slots 52 whereby the cranking dogs 54 are received with the recesses and slots. The dogs 54 are formed of a synthetic plastic material and each includes a cylindrical hub 56 received within a pulley recess 50 wherein the dogs are pivotally mounted upon the pulley hub. The width of the hub dog receiving slot 52 is sufficient to permit the dogs to pivot between the retracted position shown in FIG. 2 and the extended position illustrated in FIG. 3.

Figure 4:
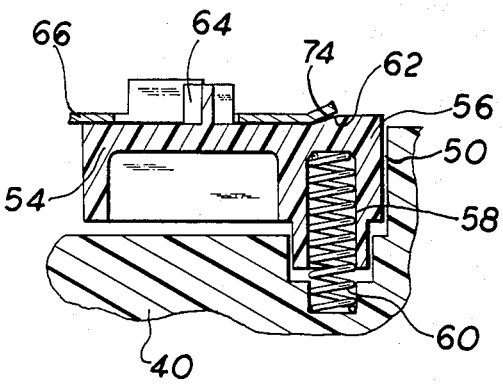
FIG. 4 is an enlarged, detail, elevational, sectional view taken through a dog and dog operator along Section IV—IV of FIG. 2, the dog being shown in the fully retracted position.

Each dog hub 56 is provided with a bore 58, FIG. 4, and a compression spring 60 is received within the bore and the pulley hub recess which biases the dog in an axial direction away from the pulley. The dogs are each provided with an oblique cam abutment surface 62 at the hub 56, and a projection 64 homogeneously extending from the dog cooperates with the dog operator, as later described, to produce the dog pivotal movement. The outer end of each dog is provided with a radiused edge complementary in configuration to the abutment surfaces 28 defined upon the engine cranking cup 20.

The dogs 54 are retained within their pulley hub recesses 50 by the sheet metal dog operator 66. The dog operator is of a configuration which will be apparent from FIGS. 2 and 3 and includes a central hole through which the bolt 36 extends. The bolt rotatably supports the operator adjacent the outer surface of the pulley hub and a compression spring 68, FIG. 1, interposed between the hub and operator biases the operator against the head of the bolt imposing a frictional resistance to rotation upon the operator.

Figure 6:
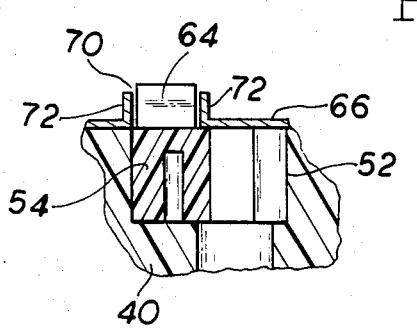
FIG. 6 is an enlarged, detail, elevational, sectional view as taken along Section VI—VI of FIG. 2.

The operator includes a pair of slots 70 each defined by upstanding lanced flanges 72, FIG. 6, of displaced metal which receive a dog projection 64. Thus, as relative rotation takes place between the operator and pulley, the engagement of the dog projection with the flanges 72 will cause the dogs to pivot outwardly to the extended position of FIG. 3, or inwardly to the retracted position of FIG. 2.

Figure 5:
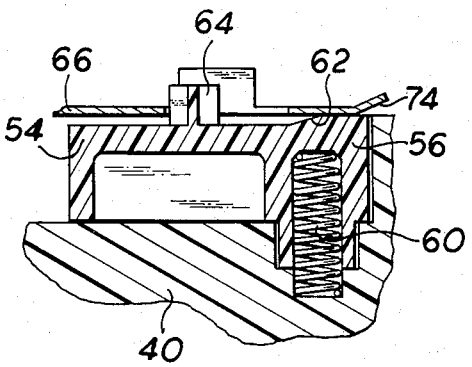
FIG. 5 is an elevational, detail, sectional view similar to FIG. 4, illustrating the position of the dog during cranking.

The dog operator 66 is provided with a pair of cam surfaces 74, a surface being located at each longitudinal edge thereof, wherein the cam surfaces are obliquely oriented and located above the dog hubs 56. As will be appreciated from FIGS. 4 and 5, the angular configuration of the operator cam surfaces 74 substantially corresponds to that of the detent abutment surfaces 62, and when the operator is in the dog retract position bf FIG. 2 and FIG. 4, the dog abutment surface 62 will be held in engagement with the operator cam surface 74 by the spring 60 which forces the dog against the operator and functions as a detent to resist movement of the operator over the dog as shown in FIG. 5. In order for the dog and operator to be displaced to the dog extended position, as represented in FIG. 5, it is necessary for the cam surface 74 to depress the associated dog 54, and depress spring 60, as shown in FIG. 5.

In operation, the components will be assembled as shown in FIGS. 1 and 2, and in the normal "at rest" condition, the dogs will be retracted as shown in FIG. 2 from the previous cranking cycle. The operator cam surfaces 74 will be engaging the dog abutment surfaces 62, and the operator slots 70 will be retaining the dog ends pivoted inwardly out of possible engagement with the engine cranking cup 20. Thus, while the engine is running, the dogs 54 act as detents due to the interrelationship of the surfaces 62 and 74 preventing relative rotation between the operator 66 and the pulley 32 which would cause the dogs to be extended outwardly, and in this manner the detent action provided by the dogs prevents inadvertent engagement of the dogs and engine cup even under high vibration conditions.

When it is desired to crank the engine, the operator pulls upon the handle 48 unwinding rope 44 within pulley groove 42. The pulley rotates in a clockwise direction, FIGS. 2 and 3, and the resistance to rotation of the operator 66 due to the braking friction action of the spring 68 is sufficient to permit the operator cam surfaces 72 to depress the dogs toward the pulley as shown in FIG. 5. This compression of springs 60 does produce a slight resistance to pulley rotation, but after the springs are compressed, further resistance to pulley rotation due to this detent action of the dogs ceases.

Figure 3:
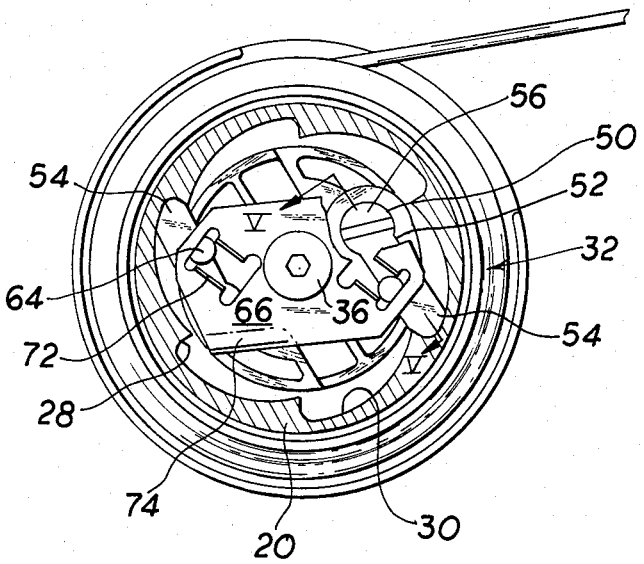
FIG. 3 is a plan view of the rope pulley and directly associated components of the starter illustrating the components in the dog extended engine driving relationship.

As the pulley rotates relative to the operator 66 the dog projection 64 will engage the innermost slot flange 72 pivoting the dogs to the extended position of FIG. 3 permitting the dogs to engage an engine cup abutment 28. Extension of the dogs will be limited by the engagement of the dogs with the cup abutments and upon the dogs firmly engaging the cup abutments, the engine will be cranked and started. As soon as the engine starts, or fires, the cup 20 will rotate faster than the pulley 32 and a cup cam surface 30 will engage the dogs pivoting the same in a clockwise direction, FIG. 3, causing the dog projections 64 to engage the operator flanges pivoting the operator relative to the hub retracting the dogs to the position of FIG. 2, and upon release of the rope, the recoiling of the pulley and the braking action on the operator 66 assures that the operator will retain the dogs in the retracted condition and the components will maintain the relationship of FIG. 2 upon the recoiling being completed.

The pulley recoil spring 76 is mounted within the synthetic plastic keeper 78, and the interrelationship between the spring and the keeper is similar to that described in the assignee's U.S. Pat. No. 3,375,814. The spring keeper includes an axial extension 80 which comprises a skirt extending over the pulley groove 42 as apparent in FIG. 1, and the skirt includes an opening 82, FIG. 2, through which the starter rope extends. The purpose of the skirt 80 is to substantially enclose the pulley rope groove and aid in maintaining the rope within the pulley groove during rewinding. The skirt is of particular advantage when the rope very quickly rewinds as occasionally happens when the operator inadvertently releases the rope handle when the starter rope is extended.

The air flow cooling the engine is represented by the arrows of FIG. 1 and the air will flow through the starter housing vents over the flywheel due to the usual vanes defined upon the flywheel, not shown. In order that the starter not restrict this air flow, this starter pulley rim 84 is provided with a slightly concave conical surface 86 which minimizes the restriction to air flow past the starter, and aids in guiding the air into the flywheel vanes.

The starter pulley rim 84 includes a cylindrical inner surface 88 wherein an annular chamber 90 is defined between the rim surface 88 and the hub 40 into which the outer end of the cranking cup 20 is received. As the outer surface 26 of the engine cranking cup is cylindrical, and as the inner surface 88 of the pulley rim is cylindrical, the reception of the engine cup into the annular chamber 90 aids in maintaining a concentric relationship between the engine flywheel and starter pulley, and this relationship is helpful during assembly, as well as during operation due to slight distortion of the housing during cranking.

It will be appreciated that various modifications to the inventive concepts will be apparent to those skilled in the art without departing from the spirit and scope of the invention.

We claim:

1. A recoil starter for internal combustion engines wherein the starter comprises a supporting housing, a pulley mounted upon the housing rotatable in cranking and rewind directions about an axis and having a rope receiving groove defined therein, a rope within the pulley groove, a recoil spring interposed between the housing and pulley biasing the pulley in the rewind direction, a dog movably mounted upon the pulley movable between a retracted position and an extended position and a dog operator mounted adjacent the pulley rotatable about the pulley axis operatively connected to the dog having a first rotative position relative to the pulley moving the dog to the extended position upon the pulley rotating in the cranking direction and having a second rotative position relative to the pulley moving the dog to the retracted position upon the pulley rotating in the rewind direction, the improvement comprising, spring operated displaceable detent means interposed between the pulley and dog operator maintaining the dog operator in its second position, said detent means being overcome upon the pulley being rotated by the rope in the cranking direction.

2. In a recoil starter as in claim 1, said detent means comprising a cam surface defined upon the dog operator and a movable spring biased element mounted upon the pulley engaging said cam surface when the dog operator is at its second position.

3. In a recoil starter as in claim 2, said element comprising the dog, said spring biasing the dog toward the dog operator.

4. In a recoil starter as in claim 3, a cam surface abutment surface defined upon the dog, said spring biasing said dog abutment surface into engagement with said dog operator cam surface.

5. In a recoil starter as in claim 4, the dog being pivotally mounted upon the pulley for pivotal movement about an axis substantially parallel to the pulley axis when shifting between its retracted and extended positions, the dog being axially movable upon the pulley toward and away from the dog operator, said spring biasing the dog toward the dog operator whereby the dog abutment surface engages the operator cam surface when the dog operator is at its second position.

6. In a recoil starter as in claim 5, the dog including a hub, a recess defined in said hub, said spring comprising a compression spring.

7. In a recoil starter as in claim 2, the dog operator comprising a flat plate rotatable about the pulley axis, friction brake means resisting rotation of said plate, said cam surface comprising a portion of said plate obliquely deformed from the general plane of said plate.

8. A recoil starter for internal combustion engines wherein the starter comprises a supporting housing, a pulley mounted upon the housing rotatable in cranking and rewind directions about an axis and having a rope receiving groove defined therein, a rope within the pulley groove, a recoil spring interposed between the housing and pulley biasing the pulley in the rewind direction, a dog movably mounted upon the pulley movably between a retracted position and an extended position and a dog operator mounted adjacent the pulley rotatable about the pulley axis operatively connected to the dog having a first rotative position relative to the pulley moving the dog to the extended position upon the pulley rotating in the cranking direction and having a second rotative position upon the pulley rotating in the rewind direction, the improvement comprising, an annular cranking cup adapted to be attached to the engine to be started, said cup having an outer cylindrical surface and an inner surface having dog engaging surfaces defined thereon, a hub defined upon the pulley, the dog being mounted upon the pulley hub and radially extendable therefrom, an axially extending rim defined upon the pulley in radial alignment with said hub and radially spaced therefrom wherein an annular chamber is defined within the pulley by said hub and rim, said rim having a cylindrical inner surface and an outer surface, said cup being received within said chamber wherein said cup outer surface is in opposed radial relationship to said rim inner surface and said rim aids in maintaining said cup concentric to the pulley.

9. In a recoil starter as in claim 8, ventilation vents defined in the housing, said rim outer surface being substantially conical converging in a direction away from the housing.

10. A recoil starter for internal combustion engines wherein the starter comprises a supporting housing, a pulley mounted upon the housing rotatable in cranking and rewind directions about an axis and having a rope receiving groove defined therein, a rope within the pulley groove, a recoil spring interposed between the housing and pulley biasing the pulley in the rewind direction, a dog movably mounted upon the pulley movable between a retracted position and an extended position and a dog operator mounted adjacent the pulley rotatable about the pulley axis operatively connected to the dog having a first rotative position relative to the pulley moving the dog to the extended position upon the pulley rotating in the cranking direction and having a second rotative position relative to the pulley rotating in the rewind direction, the improvement comprising, an annular spring keeper mounted upon the housing, the recoil spring being located within said spring keeper, an annular skirt defined upon said keeper concentric to the pulley axis and axially extending along the pulley in radial alignment with the pulley groove and adjacent the pulley circumference retaining the rope within the pulley groove, and a rope opening defined within said skirt.

* * * * *